US008459506B2

(12) United States Patent
Schiller et al.

(10) Patent No.: US 8,459,506 B2
(45) Date of Patent: Jun. 11, 2013

(54) DISPENSING ASSEMBLY WITH SHUT OFF VALVE, BACKFLOW PREVENTER, AND METHODS OF OPERATING THE SAME

(75) Inventors: Steven E. Schiller, Kenosha, WI (US); Paul Larson, Racine, WI (US); James L. Bournoville, Racine, WI (US)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/639,365

(22) PCT Filed: Apr. 5, 2011

(86) PCT No.: PCT/US2011/031212

§ 371 (c)(1),
(2), (4) Date: Oct. 9, 2012

(87) PCT Pub. No.: WO2011/127031

PCT Pub. Date: Oct. 13, 2011

(65) Prior Publication Data

US 2013/0020353 A1 Jan. 24, 2013

Related U.S. Application Data

(60) Provisional application No. 61/321,682, filed on Apr. 7, 2010.

(51) Int. Cl.
*B67D 7/78* (2010.01)

(52) U.S. Cl.
USPC ..... 222/145.5; 239/126

(58) Field of Classification Search
USPC 222/145.5, 148–151, 391, 394, 129.1–129.4, 222/20, 50–61; 239/310, 311, 317, 104–109, 239/124–127, 597
See application file for complete search history.

(56) References Cited

U.S. PATENT DOCUMENTS

| | | | | | |
|---|---|---|---|---|---|
| 3,383,044 | A | * | 5/1968 | Norstrud et al. | 239/126 |
| 3,760,982 | A | * | 9/1973 | Haase | 222/63 |
| 4,046,385 | A | * | 9/1977 | Hunt | 369/216 |
| 4,311,160 | A | * | 1/1982 | Charland | 137/111 |
| 4,687,138 | A | * | 8/1987 | Ostergaard | 239/126 |
| 4,951,713 | A | * | 8/1990 | Jordan et al. | 137/895 |
| 5,529,460 | A | * | 6/1996 | Eihusen et al. | 417/20 |
| 5,558,503 | A | * | 9/1996 | Weller et al. | 417/307 |

* cited by examiner

*Primary Examiner* — Lien Ngo
(74) *Attorney, Agent, or Firm* — Michael Best & Friedrich LLP

(57) ABSTRACT

A dispensing assembly for dispensing a mixture of fluids is provided. In some embodiments, the dispensing assembly includes a first valve for selectively permitting fluid flow to a mixing chamber in which a second fluid is introduced, wherein the valve is actuated between open and closed positions responsive to fluid pressure downstream of the mixing chamber. In such embodiments, the fluid pressure downstream of the mixing chamber can change based upon whether fluid is dispensed from a spray gun, wand, nozzle, or other dispensing head of the dispensing assembly.

10 Claims, 11 Drawing Sheets

DISPENSING ASSEMBLY WITH SHUT OFF VALVE, BACKFLOW PREVENTER, AND METHODS OF OPERATING THE SAME

BACKGROUND

Many applications of fluid dispensing systems call for fluid to be delivered under pressure and in a controlled mariner (e.g., at desired times) without requiring a complex design to prevent backflow of fluid through the system. Unfortunately, many conventional fluid dispensing systems employ designs with signal hoses or other connections between a valve controlling fluid flow and a spray gun, wand, nozzle assembly, or other dispensing head though which fluid is dispensed. Alternatively or in addition, conventional fluid dispensing systems often waste significant fluid when the system is not in use, and/or maintain connection with a potable water supply when the system is not in use. Coupled with the complexity and cost of many conventional fluid dispensing systems, new systems continue to be welcome in the art.

SUMMARY

In some embodiments, a dispensing assembly for dispensing at least one fluid is provided, and comprises a source of a first fluid; a valve having opened and closed positions in which the valve permits and inhibits flow of the first fluid, respectively; a source of a second fluid; a first chamber in fluid communication with the source of the first fluid via the first valve, and in fluid communication with the source of the second fluid; a dispenser outlet through which the first and second fluids are dispensed from the dispenser assembly, the dispenser outlet having opened and closed states in which flow of the first and second fluids from the dispenser outlet is permitted and inhibited, respectively; and a second chamber in fluid communication with the first chamber; the first valve movable from the opened position to the closed position responsive to a change in fluid pressure within the second chamber, and movable from the closed position to the opened position responsive to an opposite change in fluid pressure within the second chamber.

Other aspects of the present invention will become apparent by consideration of the detailed description and accompanying drawings.

DETAILED DESCRIPTION

Before any embodiments of the present invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

Figure 1:
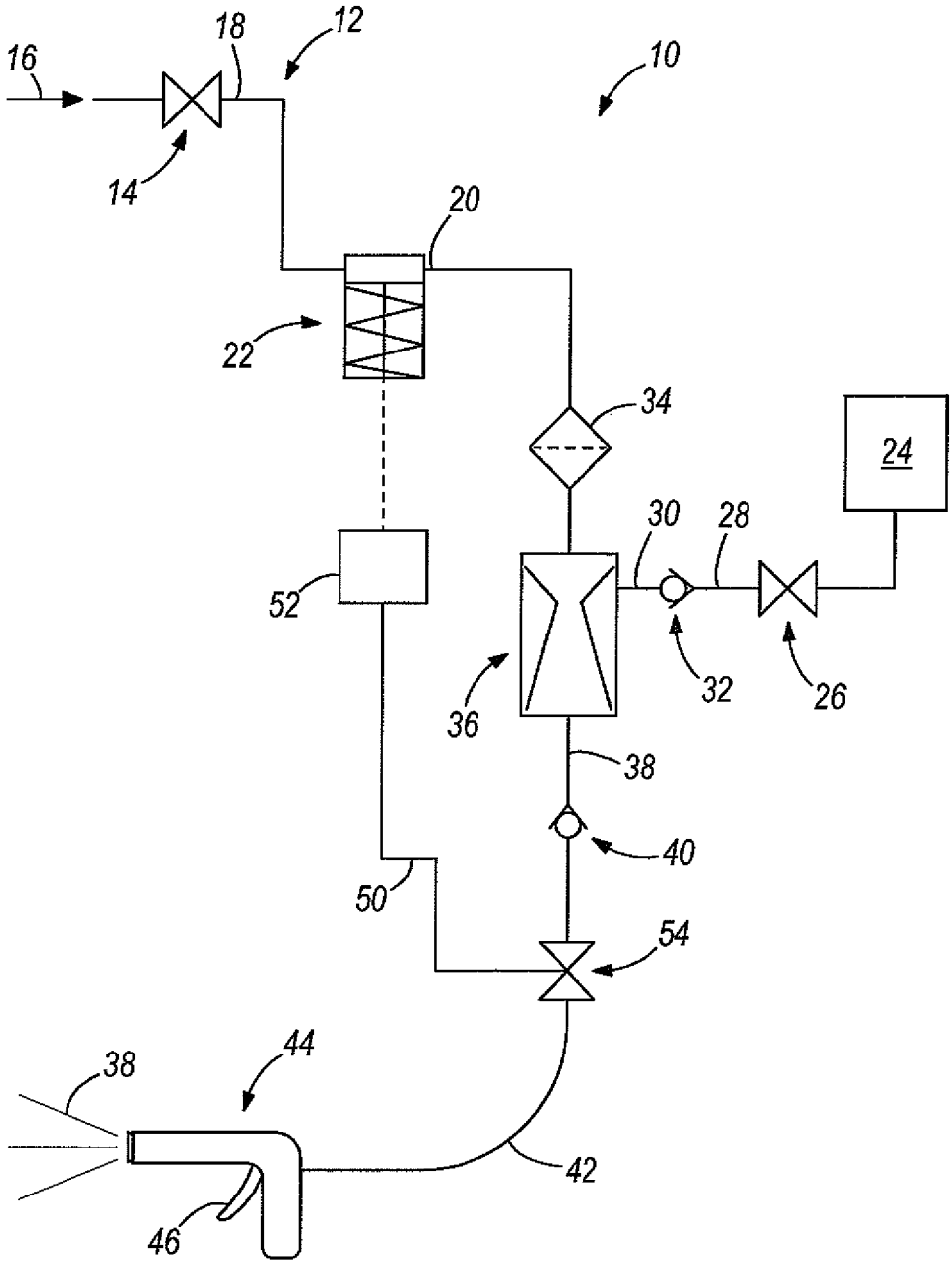
FIG. 1 is a schematic view of a fluid dispensing assembly according to an embodiment of the present invention.

FIG. 1 shows a dispensing assembly 10 fluidly coupled to a source of fluid 12, such as via a plumbed line to municipal water source, a reservoir, or other source of fluid. In some embodiments, the fluid is water, although the dispensing assembly 10 can be used in conjunction with other types of fluids. For purposes of example only, the fluid received from the fluid source 12 in the embodiments described below is water, it being understood, however, that other fluids can instead be used as desired. The source of water 12 in the illustrated embodiment can be selectively placed in fluid communication with the dispensing assembly 10 via a shut off valve 14 of any suitable type. Water flows in the direction of arrow 16 along a length of conduit 18 into a first inlet 20 of the dispensing assembly 10. The illustrated dispensing assembly 10 includes a first valve 22 that permits water to flow into the first inlet 20 from the source of water 12 when in an open position, and inhibits water from flowing into the first inlet 20 from the source of water 12 when in a closed position.

A source of a second fluid 24, such as a reservoir containing cleaner, disinfectant, or other fluid to be mixed with water from the source of water 12, is fluidly coupled to the dispensing assembly 10. For purposes of example only, the fluid received from the second fluid source 24 in the embodiments described below is cleaning agent in concentrate form, it being understood, however, that other fluids (including water) can instead be used as desired. The source of cleaning agent 24 can include a shut off valve 26 to selectively inhibit flow of cleaning agent into the dispensing assembly 10. A length of conduit 28 extends between the source of cleaning agent 24 and a second inlet 30 of the dispensing assembly 10. In some embodiments, the dispensing assembly 10 includes a first check valve 32 that permits cleaning agent to flow into the second inlet 30, but inhibits fluid flow from the second inlet 30 to the source of cleaning agent 24. The source of a second fluid 24, the shut off valve 26, the conduit 28, the second inlet 30 and the first check valve 32 are optional, and are not utilized in some embodiments. For example, if water alone is to be dispensed from the dispensing assembly 10, or if a pre-mixed fluid is directed through the conduit 18, a second fluid may be unnecessary.

The illustrated dispensing assembly 10 includes a filter 34 that filters out particles, elements, or other impurities in the flow of water passing through the dispensing assembly 10. Any number and type of filters can be utilized with the dispensing assembly 10, depending at least in part upon the particular application and the cleanliness and purity of the source of water 12. In some embodiments, the dispensing assembly 10 can also or instead include a water conditioner, such as a water softener or other water treatment device.

The illustrated dispenser further includes a mixing chamber, such as the illustrated venturi chamber 36 fluidly coupled to the source of water 12 and the source of cleaning agent 24 to receive both water and cleaning agent, and to dispense a mixture 38 thereof. The mixing chamber can include a variety of venturi or educting devices, such as the mixing eductor shown in U.S. patent application Ser. No. 11/997,641 (U.S. Patent Pub. No. 2008/0223448) filed on Jul. 27, 2006, which is hereby incorporated by reference. A second check valve 40 can be positioned below the venturi chamber 36 to permit the mixture 38 to flow toward a hose 42 or other conduit, but to inhibit the mixture 38 from flowing toward the source of cleaning agent 24 and/or the source of water 12. In the illustrated embodiment, the hose 42 directs the mixture 38 toward an outlet, such as the illustrated spray gun 44. Other similar outlets, such as a wand, nozzle, or other dispensing head, can be utilized. The illustrated spray gun 44 includes an actuator 46 moveable by a user to selectively dispense the mixture 38 from the spray gun 44. In some embodiments, the second check valve 40 can be actuated under equal pressure, such that at a very little pressure differential, the second check valve 40 can permit flow from the first inlet 20 to the hose 42.

As described above, some embodiments of the present invention do not utilize the source of a second fluid 24, the shut off valve 26, the conduit 28, the second inlet 30 or the first check valve 32. In these and other embodiments, the dispenser assembly need not necessarily have a venturi chamber 36 (or other educting device) as described herein.

With continued reference to the illustrated embodiment of FIG. 1, the dispensing assembly 10 further includes a length of conduit 50 coupled upstream of the spray gun 44. The length of conduit 50 receives a portion of the mixture 38 from the venturi chamber 36, and directs the portion of the mixture 38 into an actuating cylinder 52. The actuating cylinder 52 is coupled to the first valve 22 to move the first valve 22 between open and closed positions in response to pressure in the actuating cylinder 52.

In some embodiments, fluid flow from the conduit 42 to the actuating cylinder 52 is provided via a flow sensing valve 54. The flow sensing valve 54 can regulate the flow of fluid through the dispensing assembly 10 as fluid pressure from the source of fluid 12 varies. The flow sensing valve 54 can detect whether fluid is passing the flow sensing valve 54, and can thereby control fluid pressure to the actuating cylinder 52 described above. In this manner, the flow sensing valve 54 can prevent unintended shutoff or unintended fluid dispense which could otherwise result from pressure spikes and drops of the source of fluid 12 acting upon the actuating cylinder 52. In some embodiments, the actuating cylinder 52 can accommodate flows at pressures of between about 30 psi and about 80 psi for this purpose. This pressure accommodation can also address any pressure changes originating from other parts of the dispensing assembly 10, such as flexure of the conduit 50 and/or hose 42, different biases of valve springs within the dispensing assembly 10 used at different fluid pressures, and the like. Therefore, the flow sensing valve 54 can avoid the need to change the dispensing assembly 10 or portions of the dispensing assembly 10 over various fluid pressure ranges. Also, this pressure accommodation can permit the dispensing assembly 10 to be used when the source of fluid 12 is not plumbed and not inspected, based upon the ability of the flow sensing valve 54 to accommodate variations in fluid pressure.

Figure 2:
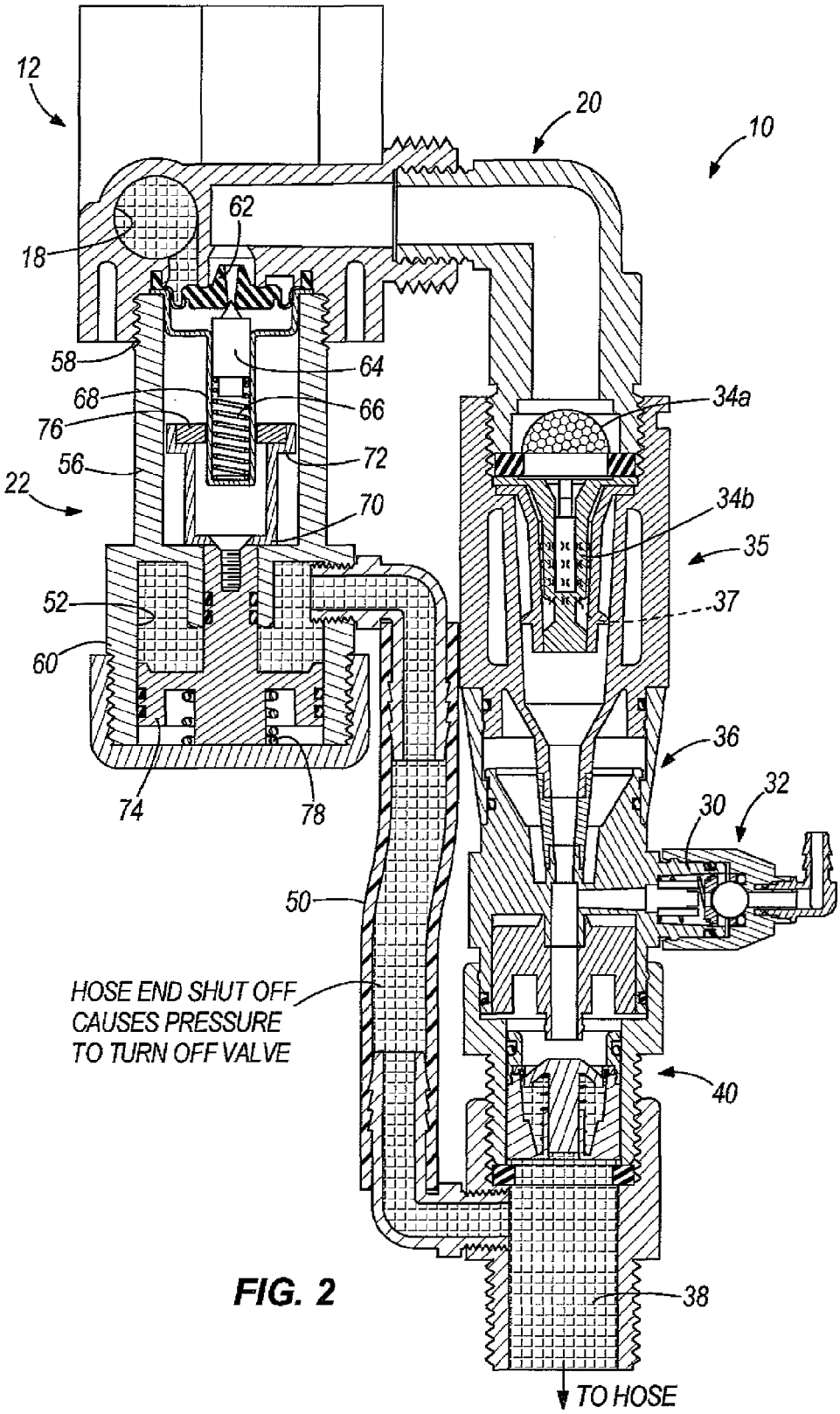
FIG. 2 is a cross-sectional view of a portion of the dispensing assembly of FIG. 1, shown in a first state.

FIG. 2 is a detail view of the dispensing assembly of FIG. 1, shown with the spray gun 44 in an off (i.e., non-flowing) state. In this state, the mixture 38 has an increased pressure due to the fact that fluid flow has been blocked at the spray gun 44. The mixture 38 flows to the actuating cylinder 52 because the second check valve 40 inhibits flow back through the venturi chamber 36, thereby causing the pressure in the actuating cylinder 52 to increase. The increased pressure in the actuating cylinder 52 moves the first valve 22 to a closed position, as shown in FIG. 2. When in the closed position, the first valve 22 inhibits, substantially prevents or prevents water from flowing from the source of water 12 into the first inlet 20 of the dispensing assembly 10. Accordingly, the first valve 22 can selectively interrupt fluid communication between the source of water 12 and the first inlet 20 and venturi chamber 36.

Figure 3:
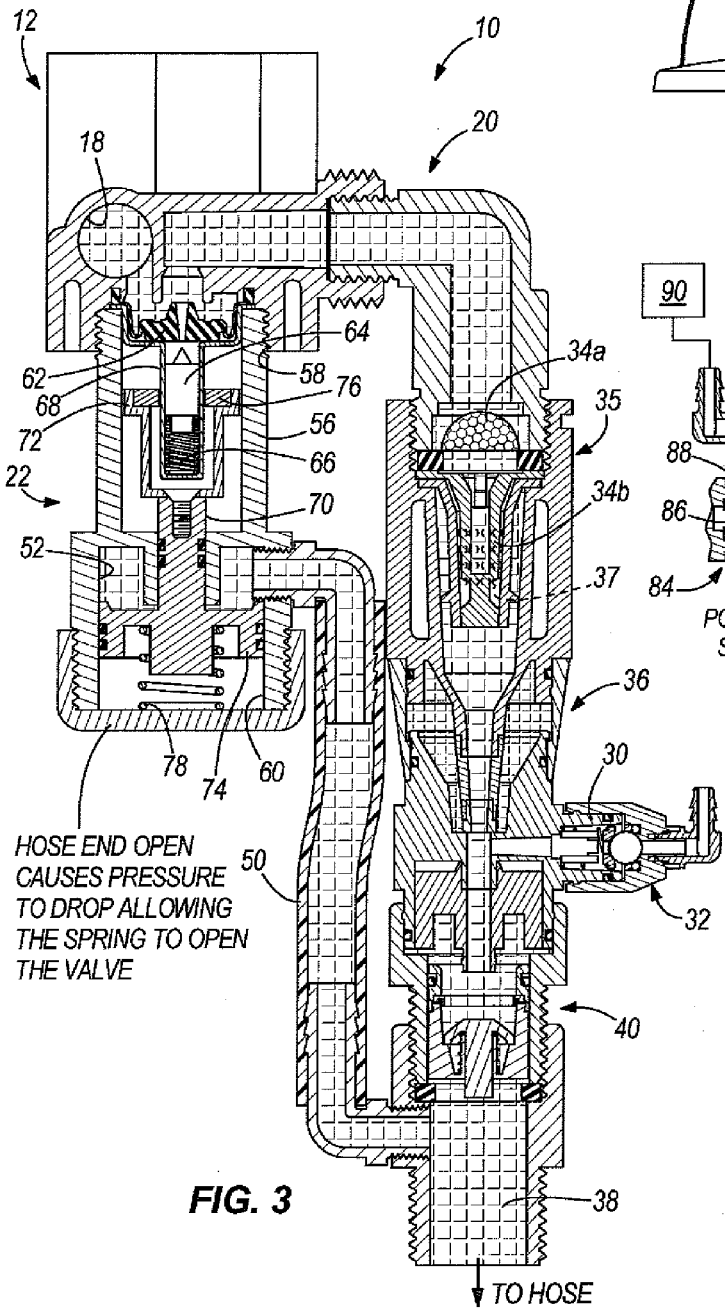
FIG. 3 is a cross-sectional view of a portion of the dispensing assembly of FIG. 1, shown in a second state.

FIG. 3 shows the dispensing assembly 10 when the spray gun 44 is actuated. In this state of the dispensing assembly 10, the mixture 38 flows through the hose 42 and is permitted to drain from the actuating cylinder 52 into the hose 42, thereby causing pressure in the actuating cylinder 52 to decrease. This decreased pressure in the actuating cylinder 52 moves the first valve 22 to an open position, as shown in FIG. 3. In the open position, the first valve 22 permits water to flow from the source of water 12 into the first inlet 20 of the dispensing assembly 10.

Some embodiments of the present invention have one or more filters for filtering out particles, chemicals, and other matter in fluid flowing from the source of water 12. By way of example only, the dispensing assembly 10 of the illustrated embodiment has a first filter 34*a* and a second filter 34*b* as shown in FIGS. 2 and 3. Also, in some embodiments, the dispenser assembly 10 includes a pipe interrupter (of which at least one of the filters 34*a*, 34*b* can be a part), which can be selected to meet the 1055B ANSI code. In the illustrated embodiment, the pipe interrupter 35 prevents the reverse flow of fluid toward the first inlet 20 through the filters 34*a*, 34*b*, and causes fluid to flow out of the apertures 37 rather than up toward the first inlet 20 as described in greater detail in U.S. Patent Pub. No. 2008/0223448 mentioned above. In some embodiments, the pipe interrupter 35 is part of an e-gap (e.g., having an elastic outer boot), such as that illustrated in FIGS. 2 and 3. In other embodiments, an air gap can be utilized in place of the illustrated e-gap. In some embodiments, the pipe interrupter 35 (or 135 in other embodiments) can be replaced with one or more pipes or other conduits.

The illustrated pipe interrupter 35 creates an outlet to permit fluid to leak to the surrounding environment if and when flow stops with sufficient back pressure at the pipe interrupter 35. In such cases, fluid is permitted to flow out of apertures 37 to vent back pressure within the dispensing assembly 10, whereas fluid instead by-passes the apertures 37 under normal flow of fluid through the dispenser assembly 10. When fluid drains out of the apertures 37, an air gap can be formed between the fluid in the first inlet 20 and the fluid in the mixture 38.

As shown in FIGS. 2 and 3, the first valve 22 includes a housing 56 coupled to the conduit 18 at a first end 58 of the housing 56, and coupled to the length of conduit 50 at a second end 60 of the housing 56. Other connection locations of the conduits 18, 50 are possible while still permitting the first valve 22 to function as described in greater detail below. The first valve 22 includes a seal 62 that is selectively in sealing engagement with the conduit 18 to inhibit the flow of water into the first inlet 20, as shown in FIG. 2. The seal 62 is also moveable out of sealing engagement with the conduit 18 to permit water to flow into the first inlet 20, as shown in FIG. 3. In some embodiments, the first valve 22 further includes a plunger 64 movable to actuate the seal 62. The plunger 64 can have any shape and size suitable for moving the seal 62, and in some embodiments is spring loaded to urge the seal 62 to a closed position. For example, the plunger 64 illustrated in FIG. 3 is biased by a spring 66 retained within a sleeve 68 that is fixed or substantially fixed to the valve housing 56. In other embodiments, other types of biasing elements (i.e., bands and other elastomeric elements) can be used to bias the plunger 64 toward the seal 62 to close the seal 62.

The first valve 22 illustrated in FIGS. 2 and 3 further comprises a piston 70 coupled for movement with respect to the valve housing 56. The piston 70 has a first end 72 positioned proximate the sleeve 68 and a second end 74 positioned within or in fluid communication with the actuating cylinder 52. The illustrated piston 70 is movable under the influence of a biasing member (e.g., a spring 78, as shown by way of example in FIGS. 2 and 3) and of fluid pressure within the actuating cylinder 52. Therefore, sufficiently large pressure changes within the actuating cylinder 52 generate movement of the plunger 64 to move the seal 62 as described above.

With continued reference to FIGS. 2 and 3, the first valve 22 includes one or more magnets 76 positioned to exert force upon the plunger 64 in at least one position of the magnet(s) 76 with respect to the plunger 64. In the illustrated embodiment, a ring-shaped magnet 76 is attached to or is defined by part of the piston 70, and exerts force upon the plunger 64 (which is made of a material responsive to a magnetic field) in at least one position of the piston 70. In other embodiments, the magnet(s) 76 can have other shapes and sizes, and can be attached to or defined by other portions of the piston 70 while still performing the function of the magnet 76 described herein. In the illustrated embodiment, the magnet 76 is located at the first end 72 of the piston 70.

The magnet 76 of the illustrated embodiment moves with the piston 70 between a first position, shown in FIG. 2, to a second position, shown in FIG. 3. When the piston 70 is in the first position, the magnet 76 is spaced sufficiently from the plunger 64 to permit the spring 66 to bias the plunger 64 against the seal 62, thereby pressing the seal 62 into a closed position as shown in FIG. 2. When the piston 70 is in the second position, the magnet 76 is sufficiently close to the plunger 64 to pull the plunger 64 away from the seal 62 against the biasing force of the spring 66, thereby allowing the seal 62 to move to an opened position as shown in FIG. 3.

In operation, when the actuator 46 on the spray gun 44 is actuated to dispense the mixture 38 from the spray gun 44, fluid pressure within the actuating cylinder 52 drops, which permits the spring 78 to move the piston 70 towards the plunger 64. Once the piston 70 has moved sufficiently toward the plunger 64, the magnetic attraction of the magnet 76 upon the plunger 64 pulls the plunger 64 away from the seal 62. Therefore, upon actuation of the actuator 46, the seal 62 is moved out of a closed position, thereby permitting water to flow into the first inlet 20 and through the dispensing assembly 10.

As water flows through the illustrated dispensing assembly 10, the water flows through the venturi chamber 36. As water flows through the venturi chamber 36, fluid is drawn through the first check valve 32 and into the second inlet 30, and combines with the cleaning agent to form the mixture 38 in a suitable ratio for the given application. The mixture 38 then flows through the second check valve 40 and out to the hose 42 and the spray gun 44 of the illustrated embodiment.

When the actuator 46 on the spray gun 44 is no longer actuated (i.e., the spray gun 44 ceases to dispense the mixture 38), fluid pressure builds within the conduit 50 and the actuating cylinder 52. As discussed above, the second check valve 40 inhibits the flow of the mixture 38 from the hose 42 into the venturi chamber 36. Fluid pressure in the actuating cylinder 52 increases, which moves the piston 70 away from the plunger 64 against the biasing force of the spring 78. As a result, the magnet 76 moves away from the plunger 64 until the biasing force of the spring 66 overcomes the magnetic attraction between the plunger 64 and the magnet 76. The spring 66 then biases the plunger 64 against the seal 62, and moves the seal 62 to a closed position to inhibit or prevent the flow of water into the first inlet 20.

Figure 4:
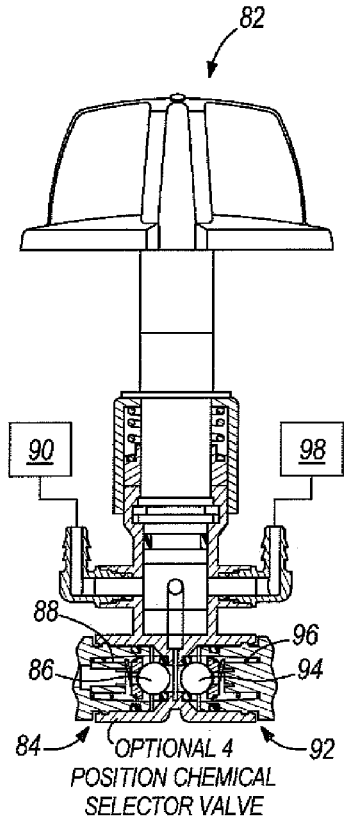
FIG. 4 is a partial cross-sectional view of a portion of a fluid dispensing assembly according to another embodiment of the present invention.

In some embodiments, the ratio of water to cleaning agent in the mixture 38 and/or the type of cleaning agent included in the mixture 38 is variable. By way of example only, another embodiment of the present invention utilizes a valve assembly 82 as shown in FIG. 4. The illustrated valve assembly 82 can be coupled to the second inlet 30 of the dispensing assembly 10. The illustrated valve assembly 82 includes a first valve 84 having a first ball 86 and a first spring 88 cooperating to control the flow of a first cleaning agent 90, and a second valve 92 having a second ball 94 and a second spring 96 cooperating to control the flow of a second cleaning agent 98.

The first valve 84 can be the same as or different than the second valve 92, such as by having a different size for a flow rate that is greater or smaller than that of the second valve 92. For example, the first ball 86 can have a different diameter than the second ball 94 and/or the first spring 88 can have a different spring constant and/or a different diameter than the second spring 96.

In some embodiments, the first valve 84 or the second valve 92 can be selectively coupled to the second inlet 30, depending upon the desired concentration of a cleaning agent to be delivered to the venturi chamber 36. For example, in some embodiments, the first valve 84 can be coupled to the second inlet 30 when a first concentration ratio of water to cleaning agent is desired, and the second valve 92 can be coupled to the second inlet 30 when a second (different) concentration ratio of water to cleaning agent is desired. In such embodiments, the first and second cleaning agents 90, 98 can be the same (e.g., can come from the same source).

In other embodiments, still more valves can exist for providing the user with still other concentrations and/or cleaning agent types to be delivered to the venturi chamber 36. A user can couple any of these valves to the second inlet 30, depending upon the type and concentration of cleaning agent desired.

The dispensing assembly 10 illustrated in FIGS. 1-3 has at least three states: an empty and off state, a charged and off state, and a charged and on state. In the empty and off state no water exists in the system, such as when the dispensing assembly 10 is empty during shipping and installation, or when fluid communication to the dispensing assembly is cut off and the dispensing assembly 10 is drained. In the charged and off state, water (and possibly a mixture of other fluid) is retained in the dispensing assembly 10, but fluid is not flowing through the dispensing assembly. The dispensing assembly 10 is in the second state after installation, but when the dispensing assembly is not in use. In the charged and on state, fluid is flowing through the dispensing assembly 10, such as when the dispensing assembly 10 is in use.

Figure 5:
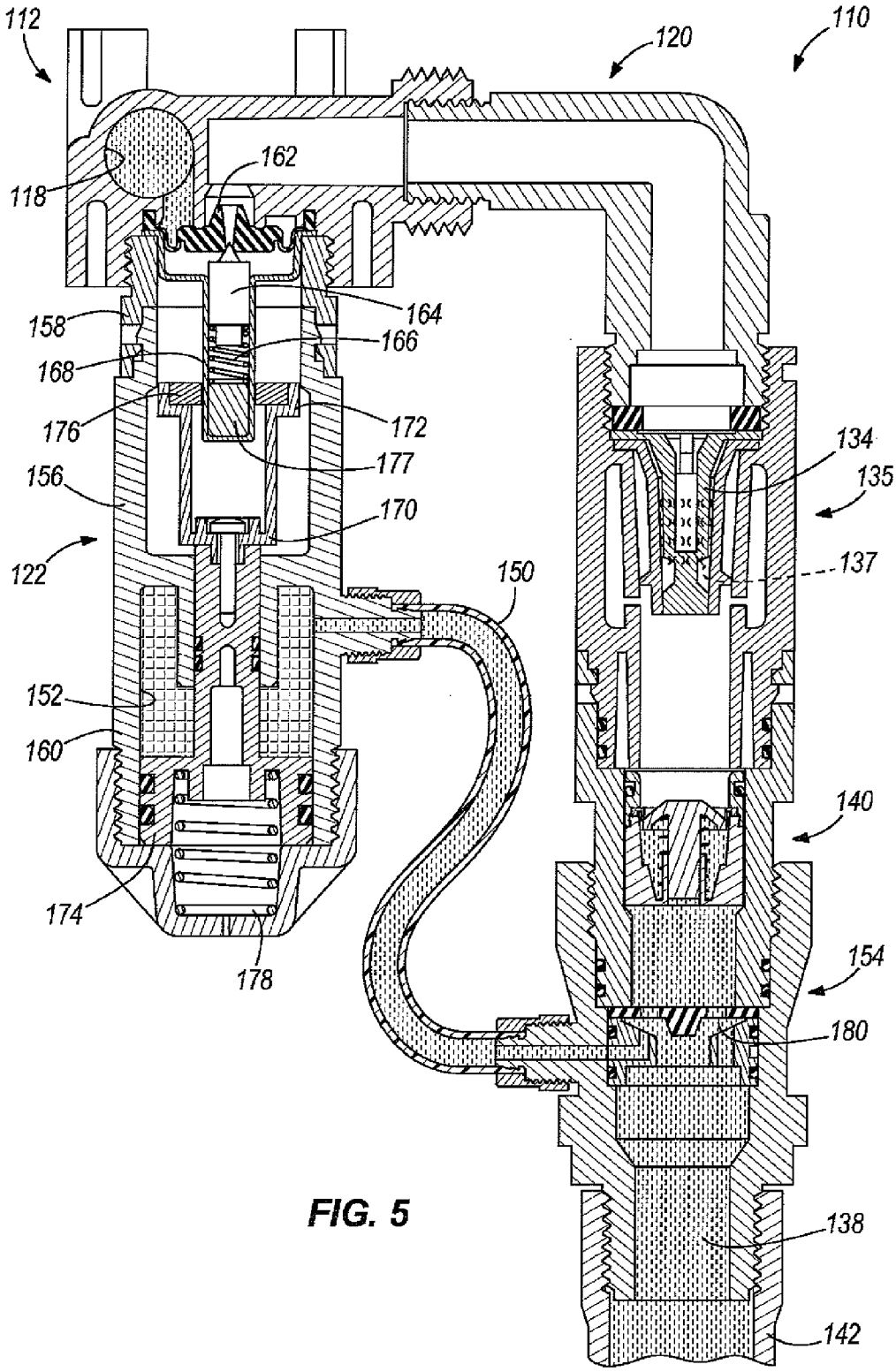
FIG. 5 is a cross-sectional view of a portion of a fluid dispensing assembly according to another embodiment of the present invention, shown in a first state.
Figure 6:
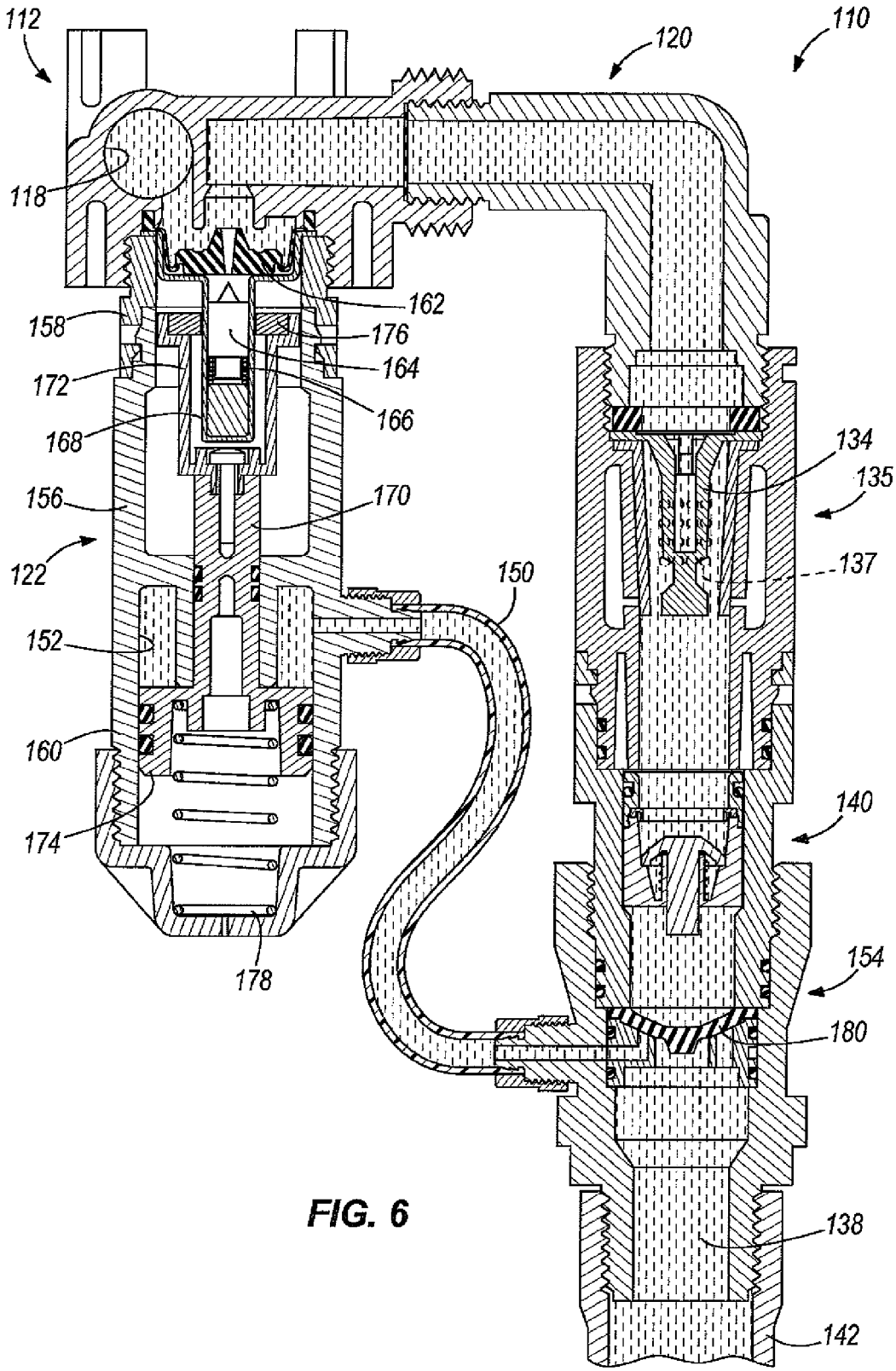
FIG. 6 is a cross-sectional view of a portion of a fluid dispensing assembly of FIG. 5, shown in a second state.

FIGS. 5 and 6 illustrate another embodiment of a dispensing assembly 110 according to the present invention. This embodiment employs much of the same structure and has many of the same properties as the embodiments of the dispensing assembly 10 described above in connection with FIGS. 1-4. Accordingly, the following description focuses primarily upon structure and features that are different than the embodiments described above in connection with FIGS. 1-4. Reference should be made to the description above in connection with FIGS. 1-4 for additional information regarding the structure and features, and possible alternatives to the structure and features of the dispensing assembly 110 illustrated in FIGS. 5 and 6 and described below. Features and elements in the embodiment of FIGS. 5 and 6 corresponding to features and elements in the embodiments described above in connection with of FIGS. 1-4 are numbered in the 100 series of reference numbers.

FIGS. 5 and 6 illustrate a dispensing assembly 110 coupled to a source of water 112 to permit water to flow along a length of conduit 118 into a first inlet 120 of the dispensing assembly 110. The illustrated dispensing assembly 110 includes a first valve 122 permitting water to flow into the first inlet 120 from the source of water 112 when the first valve 122 is in an open position (illustrated in FIG. 6), and inhibiting water from flowing into the first inlet 120 from the source of water 112 when the first valve 122 is in a closed position (illustrated in FIG. 5). The illustrated dispensing assembly 110 includes a filter or support sleeve 134 that can filter out particles, chemicals, elements, or other matter in the flow of water passing through the dispensing assembly 110. Also, the illustrated dispensing assembly 110 includes an e-gap 135 as described in greater detail in connection with the embodiment of FIGS. 1-3 above.

A second cheek valve 140 can be positioned downstream of the support sleeve 134 to permit fluid 138 to flow toward a hose 142, conduit, or other outlet, but to inhibit the fluid 138 from flowing back toward the source of water 112. With continued reference to the illustrated embodiment of FIGS. 5 and 6, the dispensing assembly 110 further includes a length of conduit 150 coupled upstream of the hose 142. The length of conduit 150 receives a portion of the fluid 138 that has flowed through the second check valve 140, and directs that portion of the fluid 138 into an actuating cylinder 152. The actuating cylinder 152 is coupled to the first valve 122 to move the first valve 122 between open and closed positions in response to pressure in the actuating cylinder 152.

As shown in FIGS. 5 and 6, the first valve 122 includes a housing 156 coupled to the conduit 118 at a first end 158 of the housing 156, and coupled to the length of conduit 150 at a second end 160 of the housing 156. Other connection locations of the conduits 118, 150 are possible while still permitting the first valve 122 to function as described in greater detail below. The first valve 122 includes a seal 162 that is selectively in sealing engagement with the conduit 118 to inhibit the flow of water into the first inlet 120, as shown in FIG. 5. The seal 162 is also moveable out of sealing engagement with the conduit 118 to permit water to flow into the first inlet 120, as shown in FIG. 6. In some embodiments, the first valve 122 further includes a plunger 164 movable to actuate the seal 162. The plunger 164 can have any shape and size suitable for moving the seal 162, and in some embodiments is spring loaded to urge the seal 162 to a closed position. For example, the plunger 164 illustrated in FIG. 6 is biased by a spring 166 retained within a sleeve 168 that is fixed or substantially fixed to the valve housing 156. In other embodiments, other types of biasing elements (i.e., bands and other elastomeric elements) can be used to bias the plunger 164 toward the seal 162 to close the seal 162.

The first valve 122 illustrated in FIGS. 5 and 6 further comprises a piston 170 coupled for movement with respect to the valve housing 156. The piston 170 has a first end 172 positioned proximate the sleeve 168 and a second end 174 positioned within or in fluid communication with the actuating cylinder 152. The illustrated piston 170 is movable under the influence of a biasing member (e.g., a spring 178, as shown by way of example in FIGS. 5 and 6) and of fluid pressure within the actuating cylinder 152. Therefore, sufficiently large pressure changes within the actuating cylinder 152 generate movement of the plunger 164 to move the seal 162 as described above.

With continued reference to FIGS. 5 and 6, the first valve 122 includes one or more magnets 176 positioned to exert force upon the plunger 164 in at least one position of the magnet(s) 176 with respect to the plunger 164. In the illustrated embodiment, a ring-shaped magnet 176 is attached to or is defined by part of the piston 170, and exerts force upon a magnet 177 coupled to the plunger 164 (or upon one or more elements coupled to the plunger 164 and made of a material responsive to a magnetic field) in at least one position of the piston 170. In other embodiments, the magnet(s) 176 can have other shapes and sizes, and can be attached to or defined by other portions of the piston 170 while still performing the function of the magnet 176 described herein. In the illustrated embodiment, the magnet 176 is located at the first end 172 of the piston 170.

The magnet 176 of the illustrated embodiment moves with the piston 170 between a first position, shown in FIG. 5, to a second position, shown in FIG. 6. When the piston 170 is in the first position, the magnet 176 is spaced sufficiently from the plunger 164 to permit the spring 166 to bias the plunger 164 against the seal 162, thereby pressing the seal 162 into a closed position as shown in FIG. 5. When the piston 170 is in the second position, the magnet 176 is sufficiently close to the plunger 164 to pull the plunger 164 away from the seal 162 against the biasing force of the spring 166, thereby allowing the seal 162 to move to an opened position as shown in FIG. 6.

A flow sensing valve 154 can be positioned upstream of the conduit 150, such as at a location upstream of the hose 142 or other outlet of the dispensing assembly 110, downstream of the e-gap 135 and/or an eductor (if used), and/or downstream of the second check valve 140. The flow sensing valve 154 regulates the flow of fluid through the dispensing assembly 110, such as in cases where fluid pressure in the conduit 150 and the actuating cylinder 152 varies. Pressure variation from a source of fluid can occur. Such pressure variation will not actuate the flow sensing valve 154, unless fluid pressure in the conduit 150 and/or the actuating cylinder 152 varies to a threshold degree. The flow-sensing valve 154 permits flow through the hose 142 and inhibits fluid flow through the conduit 150 when fluid flows from the first inlet 120. The flow-sensing valve 154 inhibits flow through the hose 142 and permits fluid flow through the conduit 150 when flow from the first inlet 120 ceases. When the flow from the first inlet 120 ceases, pressure in the conduit 150 and the actuating cylinder 152 substantially equalizes.

When there is a demand for fluid, pressure in the conduit 150 is relieved, so that the spring 178 forces the first valve 122 open. Fluid flows through the pipe interrupter 135 and the second check valve 140 to force the flow sensing valve 154 to cut off flow to the actuating cylinder 152. The flow sensing valve 154 of FIGS. 5 and 6 includes a diaphragm 180 that moves between a first position (shown in FIG. 5) and a second position (shown in FIG. 6) responsive to fluid flow through the flow sensing valve 154. In the first position, the diaphragm 180 permits fluid to flow into the conduit 150, whereas in the second position, the diaphragm 180 is urged by fluid flow through the dispensing assembly 110 to substantially or completely block flow into the conduit 150. The flow sensing valve 154 thereby limits or eliminates the opportunity for the dispensing assembly 110 to fail to turn on or off as a result of water pressure fluctuations within the dispensing assembly 110. In this regard, the position of the flow sensing valve 154 is independent or at least partially independent of water pressure of the source of water 112, or is independent of a range of water pressures of the source of water 112. Thus, the dispensing assembly 110 is operable over a wide variety of fluid pressures at the source of water 112.

FIGS. 7-11 illustrate other embodiments of a flow sensing valve 254, 354, 454 and 554 for use with any of the previously illustrated dispensing assemblies in FIGS. 1-6. Accordingly, the following description focuses primarily upon structure and features that are different than the flow sensing valves 54 and 154 described above in connection with FIGS. 1-6. Reference should be made to the description above in connection with FIGS. 1-6 for additional information regarding the structure and features, and possible alternatives to the structure and features of the flow sensing valves 254, 354, 454 and 554 illustrated in FIGS. 7-11 and described below. Features and elements in the embodiment of FIGS. 7-11 corresponding to features and elements in the embodiments described above in connection with of FIGS. 1-6 are numbered in respective hundred series of reference numbers.

Figure 7:
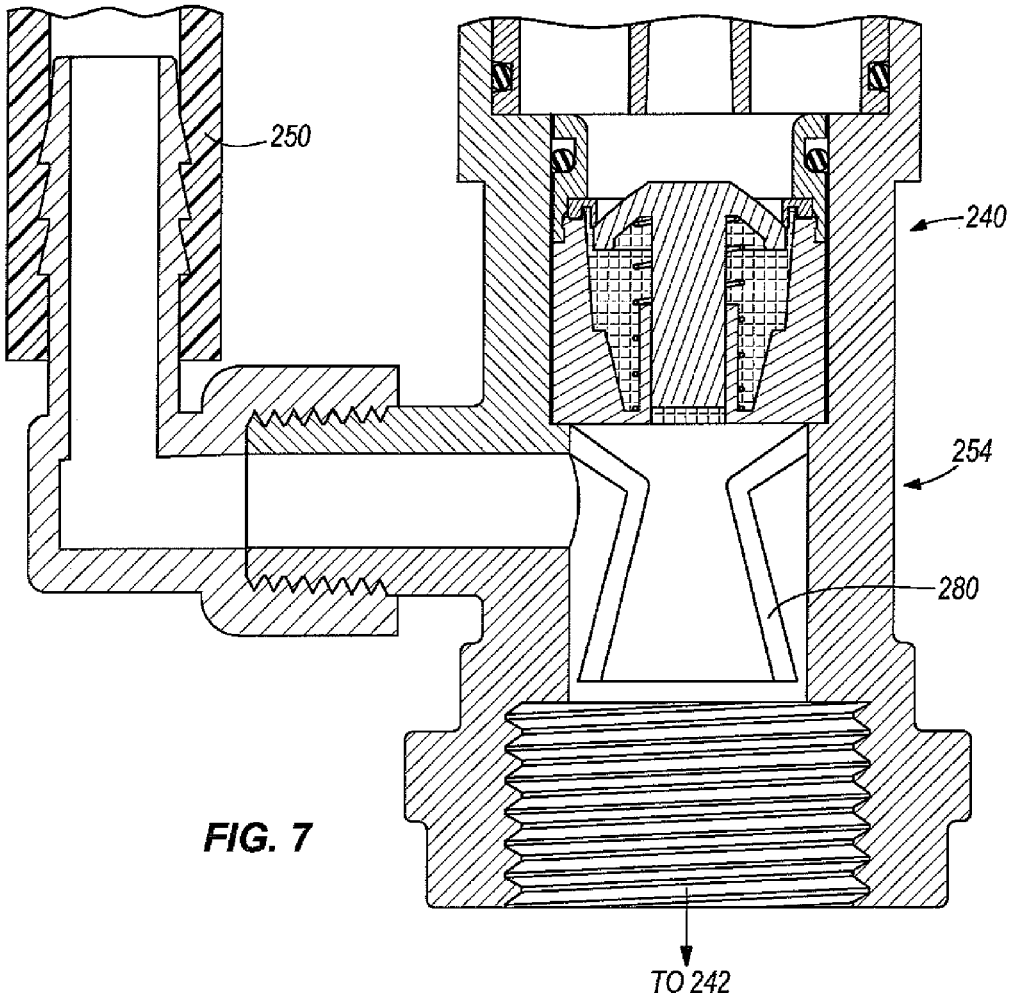
FIG. 7 is a cross-sectional detail view of a fluid dispensing assembly having a flow sensing valve according to an embodiment of the present invention.

FIG. 7 illustrates a flow sensing valve 254 coupled between a conduit 250, a second check valve 240 and a hose 242. The illustrated flow sensing valve 254 is at least partially defined by a deformable diaphragm 280 having a relaxed state as shown in FIG. 7. With sufficient fluid flow through the flow sensing valve 254, the radial walls of the diaphragm 280 expand to close off fluid communication to the conduit 250, thereby preventing a change in state of the first valve 22, 122 (not visible in FIG. 7) based upon fluctuations of fluid pressure within the dispensing assembly. Any suitable deformable material and dimensions for the diaphragm 280 can be utilized, depending at least in part upon the water pressure and the particular application. By way of example only, the diaphragm 280 can be constructed of rubber, latex, neoprene, urethane, and the like.

Figure 8:
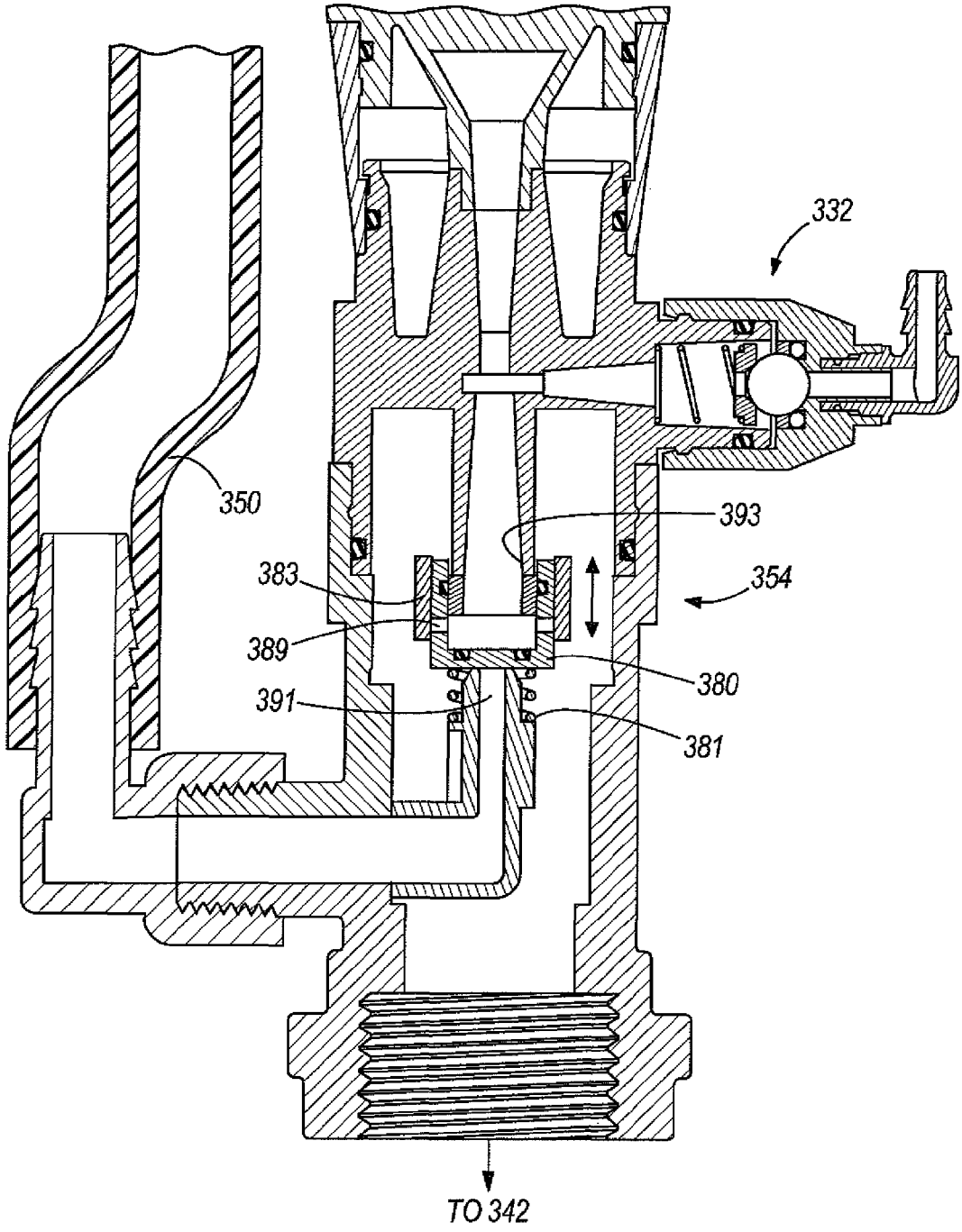
FIG. 8 is a cross-sectional detail view of a fluid dispensing assembly having a flow sensing valve according to another embodiment of the present invention.

FIG. 8 illustrates another flow sensing valve 354 coupled between a conduit 350, a first check valve 332 and a hose 342. The illustrated flow sensing valve 354 includes a moveable baffle 380 positioned in the path of fluid flow through the dispensing assembly. The baffle 380 is movable to different positions along one or more guides, such as a sleeve 383 in which the baffle 380 is at least partially received. Also, the baffle 380 is biased by one or more biasing elements (e.g., a spring 381, one or more magnets, elastomeric bands, and the like) toward a position in which fluid communication to the conduit 350 is blocked. In particular, the baffle 380 can move toward and away from a position in which one or more ports are open to permit fluid to flow into the conduit 350. For example, and with reference to FIG. 8, when no (or insufficient) flow of fluid exists through the dispensing assembly, the spring 381 biases the baffle 380 to an open position in which fluid can flow around the baffle 380, can enter a port 391 leading to the conduit 350, and in some embodiments can flow through one or more apertures 389 of the baffle 380. In contrast, when sufficient flow through the dispensing assembly exists, fluid flow impinging upon the baffle 380 causes the baffle 380 to move against the force of the spring 381 to a position in which the baffle 380 closes the port 391. The flow sensing valve 354 can also be positioned to prevent backflow of fluid by closing an upstream port 393 responsive to downstream fluid pressure against the flow sensing valve 354 and/or under force from the spring 381.

Figure 9:
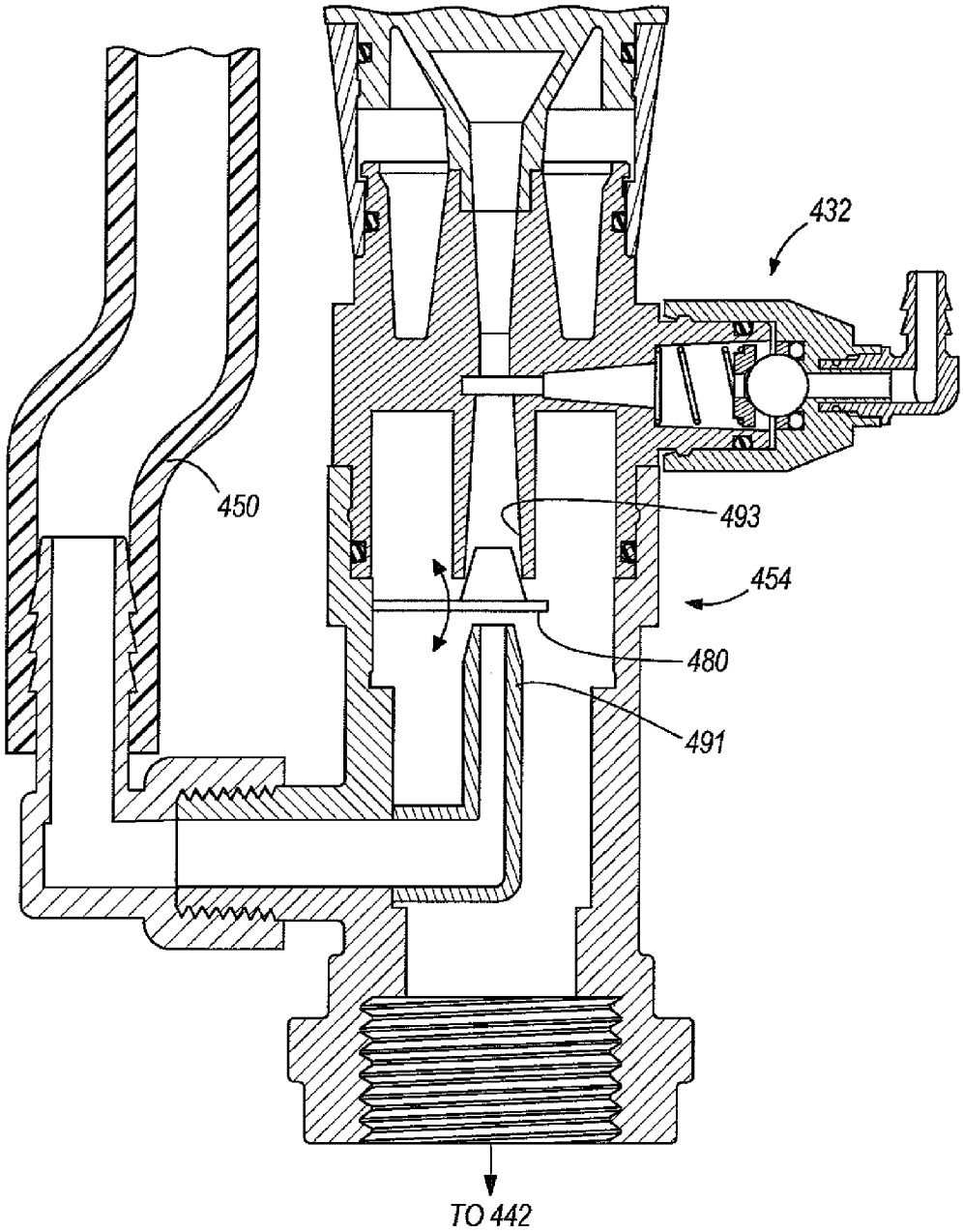
FIG. 9 is a cross-sectional detail view of a fluid dispensing assembly having a flow sensing valve according to another embodiment of the present invention.

FIG. 9 illustrates another flow sensing valve 454 coupled between a conduit 450, a first check valve 432 and a hose 442. The illustrated flow sensing valve 454 includes a moveable cantilevered diaphragm 480 that when impinged upon by sufficient fluid flow through the dispensing assembly, blocks flow of fluid into and port 491 and into the conduit 450. The flow sensing valve 454 can also be positioned to prevent backflow of fluid by closing an upstream port 493 responsive to downstream fluid pressure against the flow sensing valve 454. Any suitable material and dimensions for the diaphragm 480 can be utilized, depending at least in part upon the anticipated system pressures and the particular application.

Figure 11:
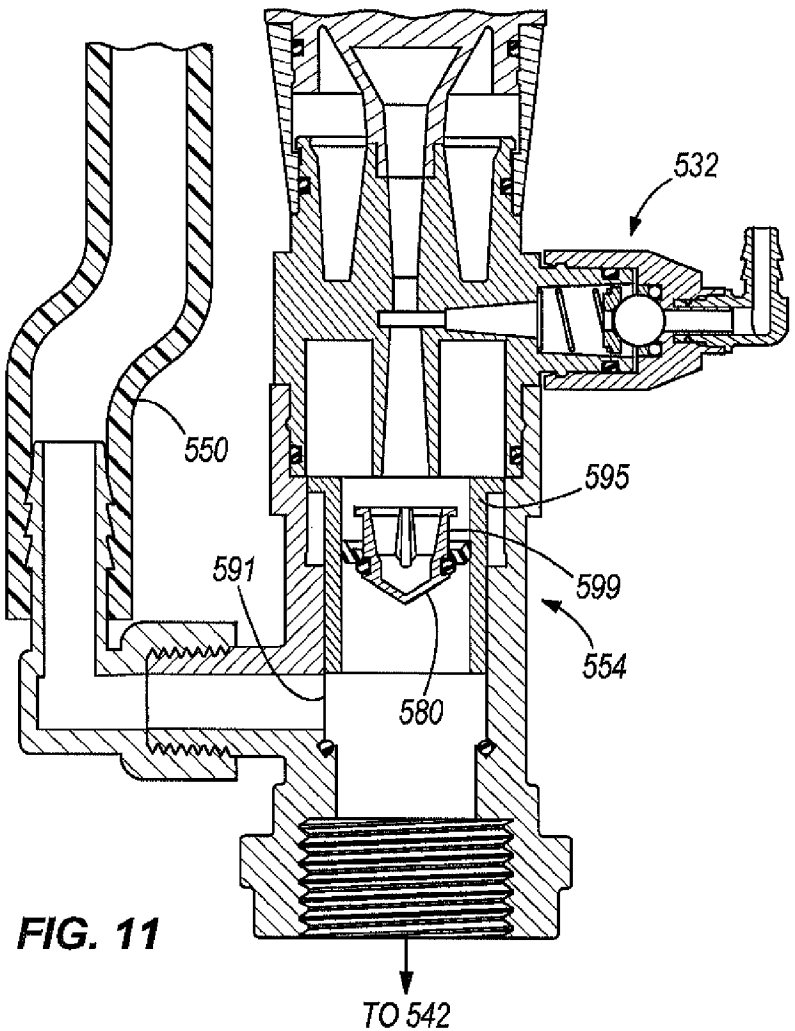
FIG. 11 is a cross-sectional detail view of a portion of the fluid dispensing assembly of FIG. 10, shown in a second state.
Figure 10:
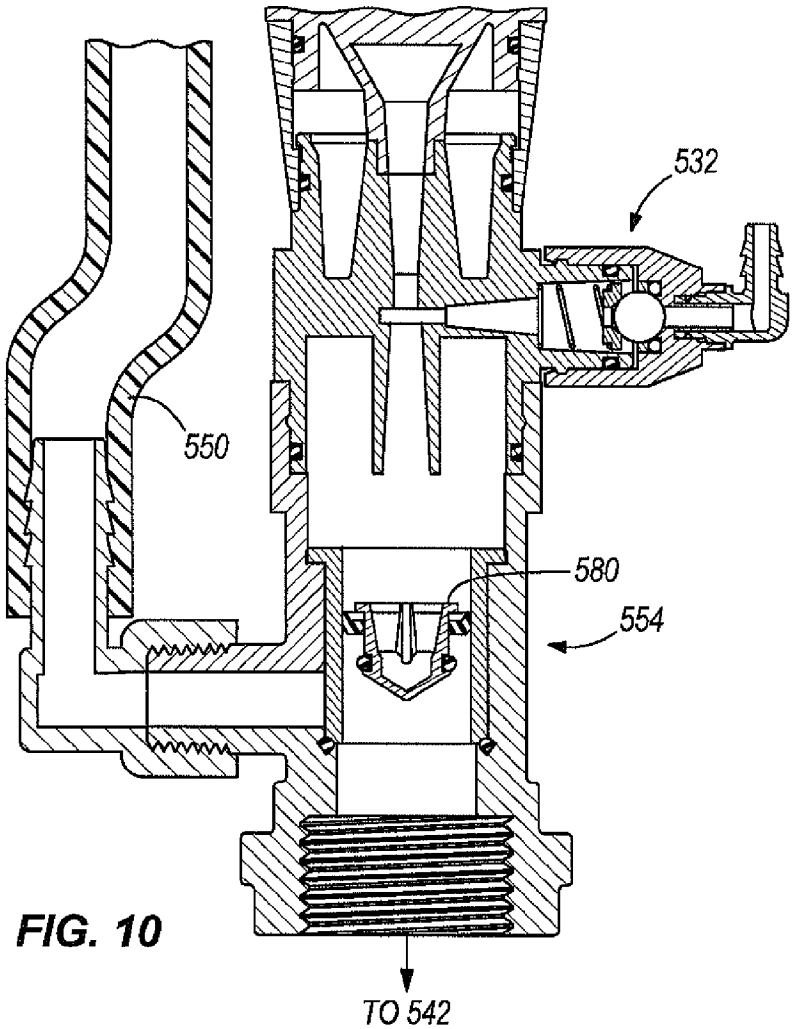
FIG. 10 is a cross-sectional detail view of a portion of a fluid dispensing assembly according to another embodiment of the present invention, shown in a first state.

FIGS. 10 and 11 illustrate yet another flow sensing valve 554 coupled between a conduit 550, a first check valve 532 and a hose 542. The illustrated flow sensing valve 554 is movable (e.g., by sliding movement of a sleeve 595 within the dispensing assembly) to and from a position in which the valve 554 blocks a port 591 leading to the conduit 550. With sufficient fluid flow through the flow sensing valve 554, the flow sensing valve 554 slides to a position in which the flow sensing valve 554 closes the port 591, whereas sufficient backpressure upon the flow sensing valve 554 causes the flow sensing valve to return to a position in which fluid communication through the port 591 is restored. The flow sensing valve 554 can also include a plug 599 that is apertured to permit fluid to flow therethrough when in one position (see FIG. 10), but that is movable to another position in which reverse fluid flow through the flow sensing valve 554 is blocked (see FIG. 11).

Figure 12:
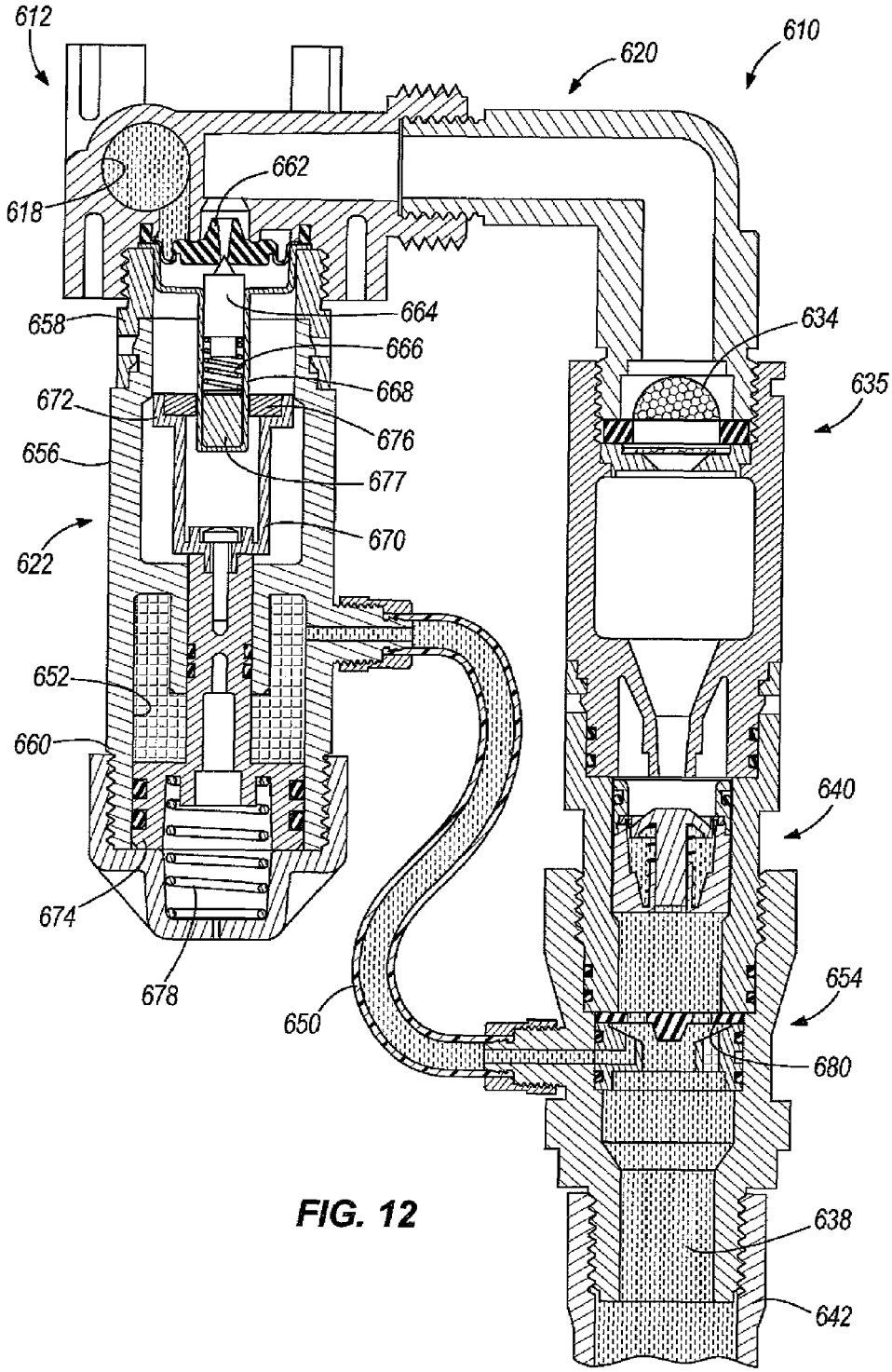
FIG. 12 is a cross-sectional view of a portion of a fluid dispensing assembly according to another embodiment of the present invention, shown in a first state.
Figure 13:
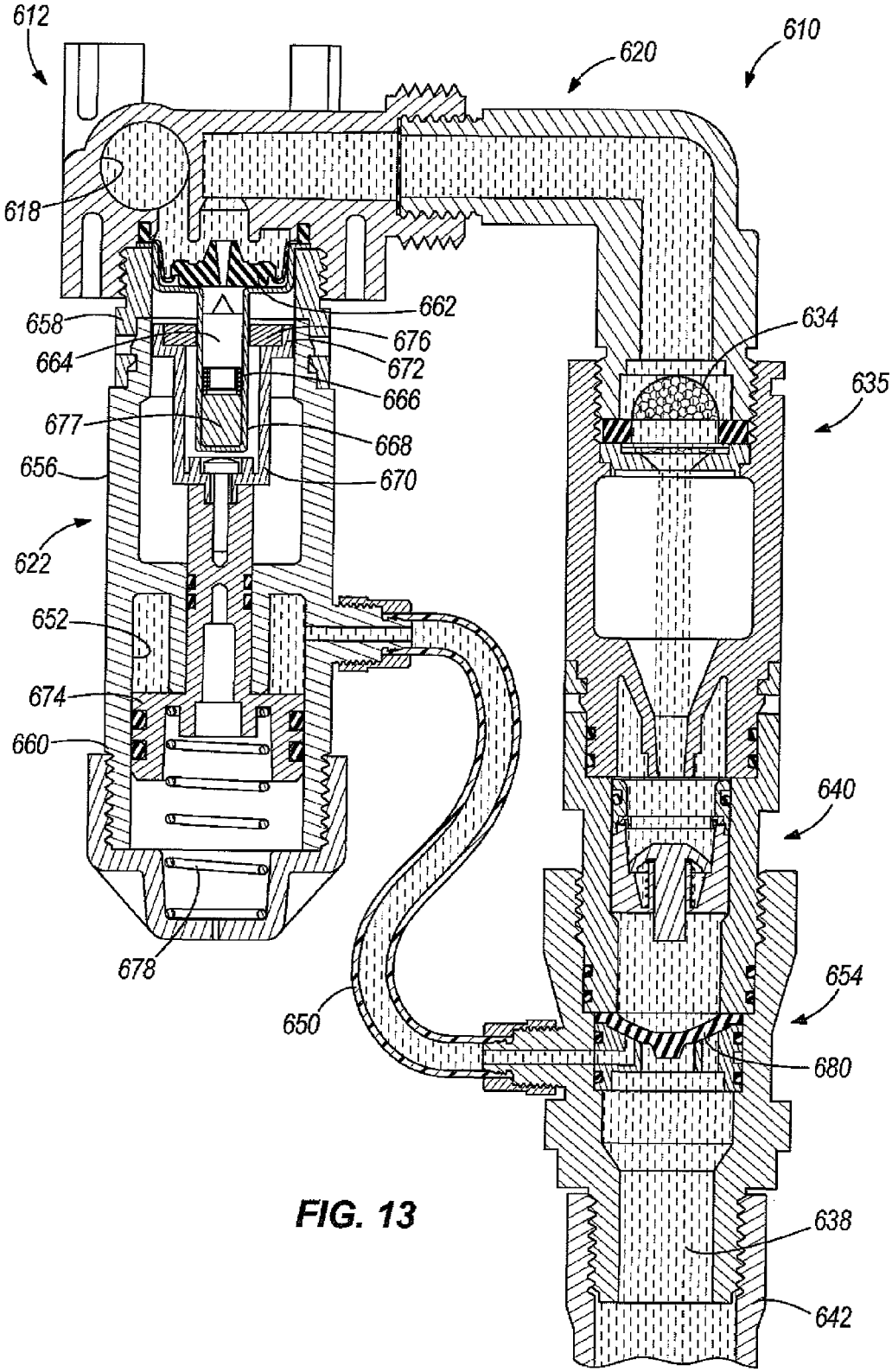
FIG. 13 is a cross-sectional view of a portion of a fluid dispensing assembly of FIG. 12, shown in a second state.

FIGS. 12 and 13 illustrate a dispensing assembly 610 coupled to a source of water 612 to permit water to flow along a length of conduit 618 into a first inlet 620 of the dispensing assembly 610. The illustrated dispensing assembly 610 includes a first valve 622 permitting water to flow into the first inlet 620 from the source of water 612 when the first valve 622 is in an open position (illustrated in FIG. 13), and inhibiting water from flowing into the first inlet 620 from the source of water 612 when the first valve 622 is in a closed position (illustrated in FIG. 12). The illustrated dispensing assembly 610 includes a support sleeve or filter 634 that can filter out particles, chemicals, elements, or other matter in the flow of water passing through the dispensing assembly 610. The illustrated filter 634 is similar to the first filter 34*a* illustrated in FIGS. 2 and 3. Also, the illustrated dispensing assembly 610 includes an c-gap or air gap 635 as described in greater detail in connection with the embodiment of FIGS. 1-3 above.

A second check valve 640 can be positioned downstream of the filter 634 to permit fluid 638 to flow toward a hose 642, conduit, or other outlet, but to inhibit the fluid 638 from flowing back toward the source of water 612. With continued reference to the illustrated embodiment of FIGS. 12 and 13, the dispensing assembly 610 further includes a length of conduit 650 coupled upstream of the hose 642. The length of conduit 650 receives a portion of the fluid 638 that has flowed through the second check valve 640, and directs that portion of the fluid 638 into an actuating cylinder 652. The actuating cylinder 652 is coupled to the first valve 622 to move the first valve 622 between open and closed positions in response to pressure in the actuating cylinder 652.

As shown in FIGS. 12 and 13, the first valve 622 includes a housing 656 coupled to the conduit 618 at a first end 658 of the housing 656, and coupled to the length of conduit 650 at a second end 660 of the housing 656. Other connection locations of the conduits 618, 650 are possible while still permitting the first valve 622 to function as described in greater detail below. The first valve 622 includes a seal 662 that is selectively in sealing engagement with the conduit 618 to inhibit the flow of water into the first inlet 620, as shown in FIG. 12. The seal 662 is also moveable out of sealing engagement with the conduit 618 to permit water to flow into the first inlet 620, as shown in FIG. 13. In some embodiments, the first valve 622 further includes a plunger 664 movable to actuate the seal 662. The plunger 664 can have any shape and size suitable for moving the seal 662, and in some embodiments is spring loaded to urge the seal 662 to a closed position. For example, the plunger 664 illustrated in FIG. 13 is biased by a spring 666 retained within a sleeve 668 that is fixed or substantially fixed to the valve housing 656. In other embodiments, other types of biasing elements (i.e., bands and other elastomeric elements) can be used to bias the plunger 664 toward the seal 662 to close the seal 662.

The first valve 622 illustrated in FIGS. 12 and 13 further comprises a piston 670 coupled for movement with respect to the valve housing 656. The piston 670 has a first end 672 positioned proximate the sleeve 668 and a second end 674 positioned within or in fluid communication with the actuating cylinder 652. The illustrated piston 670 is movable under the influence of a biasing member (e.g., a spring 678, as shown by way of example in FIGS. 12 and 13) and of fluid pressure within the actuating cylinder 652. Therefore, sufficiently large pressure changes within the actuating cylinder 652 generate movement of the plunger 664 to move the seal 662 as described above.

With continued reference to FIGS. 12 and 13, the first valve 622 includes one or more magnets 676 positioned to exert force upon the plunger 664 in at least one position of the magnet(s) 676 with respect to the plunger 664. In the illustrated embodiment, a ring-shaped magnet 676 is attached to or is defined by part of the piston 670, and exerts force upon a magnet 677 coupled to the plunger 664 (or upon one or more elements coupled to the plunger 664 and made of a material responsive to a magnetic field) in at least one position of the piston 670. In other embodiments, the magnet(s) 676 can have other shapes and sizes, and can be attached to or defined by other portions of the piston 670 while still performing the function of the magnet 676 described herein. In the illustrated embodiment, the magnet 676 is located at the first end 672 of the piston 670.

The magnet 676 of the illustrated embodiment moves with the piston 670 between a first position, shown in FIG. 12, to a second position, shown in FIG. 13. When the piston 670 is in the first position, the magnet 676 is spaced sufficiently from the plunger 664 to permit the spring 666 to bias the plunger 664 against the seal 662, thereby pressing the seal 662 into a closed position as shown in FIG. 12. When the piston 670 is in the second position, the magnet 676 is sufficiently close to the plunger 664 to pull the plunger 664 away from the seal 662 against the biasing force of the spring 666, thereby allowing the seal 662 to move to an opened position as shown in FIG. 13.

A flow sensing valve 654 can be positioned upstream of the conduit 650, such at a location upstream of the hose 642 or other outlet of the dispensing assembly 610, downstream of the air gap 635 and/or an eductor (if used), and/or downstream of the second check valve 640. The flow sensing valve 654 regulates the flow of fluid through the dispensing assembly 610, such as in cases where fluid pressure from the source of fluid 612 varies.

When there is a demand for fluid, pressure in the conduit 650 is relieved, so that the spring 678 forces the first valve 622 open. Fluid flows through the pipe interrupter 635 and the second check valve 640 to force the flow sensing valve 654 to cut off flow to the actuating cylinder 652. The flow sensing valve 654 of FIGS. 12 and 13 includes a diaphragm 680 that moves between a first position (shown in FIG. 12) and a second position (shown in FIG. 13) responsive to fluid flow through the flow sensing valve 654. In the first position, the diaphragm 680 permits fluid to flow into the conduit 650, whereas in the second position, the diaphragm 680 is urged by fluid flow through the dispensing assembly 610 to substantially or completely block flow into the conduit 650. The flow sensing valve 654 thereby limits or eliminates the opportunity for the dispensing assembly 610 to fail to turn on or off as a result of water pressure fluctuations within the dispensing assembly 610. In this regard, the position of the flow sensing valve 654 is independent or at least partially independent of water pressure of the source of water 612, or is independent of a range of water pressures of the source of water 612. Thus, the dispensing assembly 610 is operable over a wide variety of fluid pressures at the source of water 612.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, and with reference to the embodiment of FIGS. 1-3, the illustrated first check valve 32 is a ball valve, and the illustrated second check valve 40 is an umbrella valve. However, in other embodiments, the first check valve 32 and second check valve 40 can take the form of any other suitable one-way valves desired.

As another example, the conduit 50 can be replaced by a wired or wireless connection between a sensor (not shown) positioned to detect flow of fluid through the dispenser 10 and to send one or more signals to a solenoid (not shown) or other actuator to actuate the valve 22. In some embodiments, such signals can be representative of the flow rate of fluid through the conduit 50. Also in some embodiments, the conduit 50 can be or include a flow sensing device or a flow sensor of any suitable type for performing this function.

What is claimed is:

1. A dispensing assembly for dispensing at least one fluid, the dispensing assembly comprising:

a source of a first fluid;

a valve having opened and closed positions in which the valve permits and inhibits flow of the first fluid, respectively;

a source of a second fluid;

a first chamber in fluid communication with the source of the first fluid via the first valve, and in fluid communication with the source of the second fluid;

a dispenser outlet through which the first and second fluids are dispensed from the dispenser assembly, the dispenser outlet having opened and closed states in which flow of the first and second fluids from the dispenser outlet is permitted and inhibited, respectively; and a second chamber in fluid communication with the first chamber;

the first valve movable from the opened position to the closed position responsive to a change in fluid pressure within the second chamber, and movable from the closed position to the opened position responsive to an opposite change in fluid pressure within the second chamber.

2. The dispensing assembly of claim 1, wherein the first valve is movable under magnetic force from the closed position to the opened position responsive to the opposite change in fluid pressure.

3. The dispensing assembly of claim 1, wherein the first valve comprises a piston.

4. The dispensing assembly of claim 3, further comprising a magnet coupled to the piston and positioned to attract another part of the first valve in at least one position of the piston.

5. The dispensing assembly of claim 4, wherein the magnet defines at least part of the piston.

6. The dispensing assembly of claim 4, wherein the piston is spring-biased.

7. The dispensing assembly of claim 1, further comprising a second valve having opened and closed positions in which the second valve permits and inhibits flow of the second fluid, respectively, into the first chamber.

8. The dispensing assembly of claim 1, wherein the second chamber is a venturi chamber.

9. The dispensing assembly of claim 1, further comprising a flow sensing valve having opened and closed positions in which the second valve permits and inhibits flow of the second fluid, respectively, into the first chamber.

10. The dispensing assembly of claim 9, wherein the flow sensing valve includes a flexible diaphragm.

* * * * *